United States Patent [19]

Dorfman et al.

[11] Patent Number: 5,049,450

[45] Date of Patent: Sep. 17, 1991

[54] ALUMINUM AND BORON NITRIDE THERMAL SPRAY POWDER

[75] Inventors: Mitchell R. Dorfman, Smithtown; Burton A. Kushner, Old Bethpage, both of N.Y.

[73] Assignee: The Perkin-Elmer Corporation, Norwalk, Conn.

[21] Appl. No.: 521,816

[22] Filed: May 10, 1990

[51] Int. Cl.[5] ..... B32B 15/02

[52] U.S. Cl. ..... 428/570

[58] Field of Search ..... 428/570

[56] References Cited

U.S. PATENT DOCUMENTS 3,617,358 9/1967 Dittrich ..... 427/423
3,655,425 4/1972 Longo et al. ..... 75/230
4,645,716 2/1987 Harrington et al. ..... 428/472
4,894,088 1/1990 Yamaguchi et al. ..... 75/232

FOREIGN PATENT DOCUMENTS 2608171 6/1988 France .

*Primary Examiner*—R. Dean
*Assistant Examiner*—David W. Schumaker
*Attorney, Agent, or Firm*—H. S. Ingham; E. T. Grimes

[57] ABSTRACT

A composite thermal spray powder for abradable coatings is formed as homogeneously agglomerated particles. Each agglomerated particle consists of pluralities of subparticles of boron nitride and subparticles of aluminum or aluminum alloy bonded with an organic binder.

5 Claims, No Drawings

ALUMINUM AND BORON NITRIDE THERMAL SPRAY POWDER

This invention relates to thermal spray powders and particularly to composite powder of boron nitride and aluminum or aluminum alloy useful for producing abradable coatings.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically comprised of small particles, e.g., between 100 mesh U.S. Standard screen size (149 microns) and about 2 microns.

A thermal spray gun normally utilizes a combustion or plasma flame to produce the heat for melting of the powder particles. Other heating means may be used as well, such as electric arcs, resistance heaters or induction heaters, and these may be used alone or in combination with other forms of heaters. In a powder-type combustion thermal spray gun, the carrier gas, which entrains and transports the powder, can be one of the combustion gases or an inert gas such as nitrogen, or it can be simply compressed air. In a plasma spray gun, the primary plasma gas is generally nitrogen or argon. Hydrogen or helium is usually added to the primary gas, and the carrier gas is generally the same as the primary plasma gas.

One form of powder for thermal spraying is composite or aggregated powder in which very fine particles are agglomerated into powder particles of suitable size. Such powder formed by spray drying is disclosed in U.S. Pat. No. 3,617,358 (Dittrich). This method is useful for producing powder having several constituents such as a metal and a ceramic. Agglomerated powder also may be made by blending a slurry of the fine powder constituents with a binder, and warming the mixture while continuing with the blending until a dried powder of the agglomerates is obtained. U.S. Pat. No. 4,645,716 (Harrington et al) teaches a homogeneous ceramic composition produced by this method. If one of the constituents is nearly the size of the final thermal spray powder, the composite is not homogeneous and, instead, comprises the larger core particles with the finer second constituent bonded thereto. Such a clad powder is disclosed in U.S. Pat. No. 3,655,425 (Longo et al).

The latter patent is particularly directed to a clad powder that is useful for producing thermal spray coatings that are abradable such as for clearance control applications in gas turbine engines. A constituent such as boron nitride is clad to nickel alloy core particles. The boron nitride is not meltable and so is carried into a coating by the meltable metal core in the thermal spray process. The patent teaches that the core is only partially clad in order to expose core metal to the heat of the thermal spray process. Optionally, fine aluminum is added to the cladding with improvements that are speculated in the patent to be related to an exothermic reaction between the aluminum and the core metal.

Another thermal spray powder in successful use for producing abradable coatings is sold by The Perkin-Elmer Corporation as Metco 313 powder. This is formed by cladding about 50% by weight of very fine powder of an aluminum alloy containing 12% silicon onto graphite core particles. Although this material has been well established for many years as a clearance control coating in turbine engines, for certain engine parts there has been a need for improved resistance to electrochemical reaction. Also there is always a need for improved abradability of clearance control coating without sacrificing resistance to gas and particle erosion.

SUMMARY OF THE INVENTION

Therefore, an object of the invention is to provide an improved thermal spray powder useful for producing clearance control applications in gas turbine engines. Another object is to provide such a powder for producing coatings having improved resistance to electrochemical reaction in an engine environment. A further object is to provide such a powder for producing coatings having improved abradability while maintaining erosion resistance.

The foregoing and other objects are achieved by a composite thermal spray powder formed substantially as homogeneously agglomerated particles. Each agglomerated particle comprises pluralities of subparticles of boron nitride and subparticles of aluminum or aluminum alloy. The subparticles are bonded in the agglomerates with an organic binder.

DETAILED DESCRIPTION OF THE INVENTION

According to the invention a composite thermal spray powder is formed of subparticles of boron nitride and subparticles of aluminum or aluminum alloy. Preferably an aluminum-silicon alloy is utilized, particularly an alloy with 10% to 14% by weight of silicon, balance aluminum. The subparticles are bonded into agglomerated composite particles with an organic binder. Generally the boron nitride should be present as 10% to 60% by weight of the total of the boron nitride and the aluminum or aluminum alloy. The organic binder should be between 2 and 20 by weight of the subparticles, for example 10%.

Further according to the invention the agglomerated particles are substantially homogeneous with respect to the boron nitride and the aluminum or aluminum alloy. The term "homogeneous" as used herein and in the claims means that in each agglomerated particle there is a plurality of subparticles of each of the boron nitride and aluminum-containing constituents. This form of powder is expressly distinguished from a clad powder such as described in the aforementioned U.S. Pat. No. 3,655,425, such a clad powder typically having a single core particle of one constituent. One reason for beneficial results of this requirement is believed to relate to a wetting of the boron nitride by the aluminum when the latter is melted during thermal spraying. Such wetting of fine boron nitride particles seems best effected with homogeneity.

The agglomerated particles should have a relatively coarse size, generally between 44 and 210 microns. With the subparticles being generally finer such as less than 44 microns, good homogeneity is achieved. In such an example some of the subparticles near 44 microns may form agglomerated particles only slightly larger than 44 microns so that a few of such agglomerated particles may not be homogeneous; in the powder as a whole the agglomerates should be substantially homogenous.

The powder is produced by any conventional or desired method for making organically bonded agglomerate powder suitable for thermal spraying. The agglomerates should not be very friable so as not to break down during handling and feeding. One viable production method is spray drying as taught in the aforementioned U.S. Pat. No. 3,617,358. However in larger batches there is a susceptibility for significant reaction between the aluminum and the water used for the slurry in the process, producing hydrogen gas and heat which interfere with the process and constitute a hazard.

A preferred method is agglomerating by stirring a slurry of the fine powder constituents with a binder, and warming the mixture while continuing with the blending until a dried powder of the agglomerates is obtained. The organic binder may be conventional, for example selected from those set forth in the abovementioned patents. The amount of liquid binder introduced into the initial slurry is selected to achieve the proper percentage of organic solids in the final dried agglomerated powder. One or more additives to the slurry such as a neutralizer may be advantageous.

EXAMPLE

A composite powder was manufactured by agglomerating fine powder of 30 wt % boron nitride (BN) with fine powder of aluminum-12 wt % silicon alloy. The respective sizes of the fine BN and alloy powders were $-44+1$ microns and $-53+1$ microns. These powder ingredients were premixed for 30 minutes, then an organic binder (UCAR Latex 879) was added to this mixture with distilled water and acetic acid to neutralize the slurry. The container was warmed to about 135° C. and stir blending was continued until the slurry and binder were dried and an agglomerated powder formed with approximately 12% organic solids.

| | |
|---|---|
| Alloy | 1750 gm |
| BN | 750 gm |
| Binder | 750 gm |
| Water | 500 gm |
| Acetic Acid | 70 cc |

After the powder was manufactured it was top screened at 210 microns (70 mesh) and bottom screened at 44 microns (325 mesh). The powder was sprayed with a Metco Type 9MB plasma spray gun using a GH nozzle and a #1 powder port. Spray parameters were argon primary gas at 7 kg/cm$^2$ pressure and 96 1/min flow rate, hydrogen secondary gas at 3.5 kg/cm$^2$ and flow as required to maintain about 80 volts, 500 amperes, spray rate 3.6 kg/hr, spray distance 13 cm. These parameters were the same as recommended and used for the aforementioned Metco 313 powder (aluminum clad graphite), which was also sprayed for comparison.

Erosion testing at 20° impingement angle produced similar results with 1.6 and $1.7\times10^{-4}$ cc of coating per gm of abrasive being removed for the agglomerated and clad powders respectively. Abradability testing demonstrated improved abradability for agglomerated powder compared to clad powder.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A composite thermal spray powder formed substantially as homogeneously agglomerated particles each of which comprises pluralities of subparticles of boron nitride and subparticles of silicon-aluminum, the subparticles being bonded with an organic binder, and the alloy containing 10% to 14% silicon by weight of the alloy and balance aluminum and incidental impurities.

2. The composite powder according to claim 1 wherein the boron nitride is present as 10% to 60% by weight of the total of the boron nitride and the aluminum or aluminum alloy.

3. The composite powder according to claim 1 wherein the organic binder is between 2% and 20% by weight of the subparticles.

4. The composite powder according to claim 1 wherein the agglomerated particles have a size between 44 and 210 microns, and the subparticles have a size less than 10 microns.

5. A composite thermal spray powder formed substantially as homogeneously agglomerated particles each of which consists essentially of an organic binder and pluralities of subparticles of boron nitride and subparticles of aluminum-silicon alloy, wherein the subparticles are bonded with an organic binder, the alloy is substantially aluminum and 10% to 14% silicon by weight of the alloy, the boron nitride is present as 10% to 60% by weight of the total of the boron nitride and the alloy, the organic binder is between 2% and 20% by weight of the subparticles, the agglomerated particles have a size between 44 and 210 microns, and the subparticles have a size less than 10 microns.

* * * * *